US011242674B2

(12) United States Patent
Chen et al.

(10) Patent No.: US 11,242,674 B2
(45) Date of Patent: Feb. 8, 2022

(54) FAST INSTALLATION MECHANISM FOR FAUCET

(71) Applicant: Xiamen Dingshang Bathroom Products Co., Ltd., Fujian (CN)

(72) Inventors: Xianghua Chen, Xiamen (CN); Dazhao Su, Xiamen (CN)

(73) Assignee: XIAMEN DINGSHANG BATHROOM PRODUCTS CO., LTD., Fujian (CN)

( * ) Notice: Subject to any disclaimer, the term of this patent is extended or adjusted under 35 U.S.C. 154(b) by 477 days.

(21) Appl. No.: 16/383,667

(22) Filed: Apr. 15, 2019

(65) Prior Publication Data

US 2020/0277763 A1 Sep. 3, 2020

(30) Foreign Application Priority Data

Feb. 28, 2019 (CN) ..... 201920257355.7

(51) Int. Cl.
*E03C 1/00* (2006.01)
*E03C 1/02* (2006.01)
*E03C 1/04* (2006.01)

(52) U.S. Cl.
CPC ..... *E03C 1/021* (2013.01); *E03C 1/0401* (2013.01); *E03C 1/0403* (2013.01)

(58) Field of Classification Search
CPC ..... E03C 1/021; E03C 1/0401; E03C 1/0402
See application file for complete search history.

(56) References Cited

U.S. PATENT DOCUMENTS 8,899,259 B2 * 12/2014 Jonte ..... E03C 1/0402 137/315.12
10,566,777 B2 * 2/2020 Larsson ..... F21V 17/12
2004/0154096 A1 * 8/2004 Tsutsui ..... E03C 1/0403 4/695
2004/0231049 A1 * 11/2004 Meeder ..... E03C 1/0402 4/695
2006/0193712 A1 * 8/2006 Kuna ..... E03C 1/0403 411/340
2008/0131231 A1 * 6/2008 Kuna ..... E03C 1/0402 411/433
2014/0174579 A1 * 6/2014 Wilkerson ..... E03C 1/0401 137/801
2017/0009433 A1 * 1/2017 Song ..... E03C 1/0402

* cited by examiner

*Primary Examiner* — Reinaldo Sanchez-Medina
(74) *Attorney, Agent, or Firm* — Leong C. Lei

(57) ABSTRACT

A fast installation mechanism for a faucet includes a locking inner core, a fixing core, and a base. The locking inner core is a tubular member. An external thread is formed on an outer wall of the locking inner core. An upper end of the locking inner core is fixedly connected to a faucet body. A lower portion of the locking inner core is screwed into the fixing core. The base is sleeved on a lower portion of the fixing core. At least two elastic pieces on the fixing core extend out of at least two windows of the base, respectively. The installation is quick and easy, and the operation is convenient.

4 Claims, 8 Drawing Sheets

FAST INSTALLATION MECHANISM FOR FAUCET

BACKGROUND OF THE INVENTION

1. Field of the Invention

The present invention relates to a faucet, and more particularly to a fast installation mechanism for a faucet to be mounted to a countertop.

2. Description of the Prior Art

In these days, the installation mechanism of a faucet is mostly installed under a mounting surface. (The mounting surface is a countertop for mounting a kitchen basin, a washbasin, etc.) Specifically, when a conventional basin faucet or kitchen faucet is installed, the faucet is fixedly installed from the underside of the countertop by using a C-shaped fixing piece or a nut under the countertop. The clamping fixture of the conventional faucet mounting structure is disposed at the bottom of the faucet. When installed, the upper part of the faucet above the countertop needs to be fixed, and the faucet is tightened or loosened by adjusting the fixing nut. Since the fixing nut is disposed under the countertop, the space under the cabinet or the washbasin is small, the light is not good for installation, and the installation requires a relatively large workload. If the faucet is loose after installation, it is very difficult, time-consuming and labor-intensive for the user to perform the locking and maintenance operations, resulting in low installation efficiency.

SUMMARY OF THE INVENTION

The object of the present invention is to provide a fast installation mechanism for a faucet to be mounted to a countertop.

In order to achieve the above object, the present invention adopts the following technical solutions:

A fast installation mechanism for a faucet comprises a locking inner core, a fixing core, and a base. An upper portion of the fixing core is a circular sleeve. A lower portion of the fixing core is composed of at least two elastic pieces. The elastic pieces extend downward from an underside of the circular sleeve. An outer side wall of each of the elastic pieces has a boss. Internal threads are formed on inner walls of the circular sleeve and the elastic pieces. The base is a tubular member. A lower side wall of the base is formed with at least two windows. The windows correspond in number to the elastic pieces of the fixing core. The locking inner core is a tubular member. An external thread is formed on an outer wall of the locking inner core. An upper end of the locking inner core is fixedly connected to a faucet body. A lower portion of the locking inner core is screwed into the fixing core. The base is sleeved on the lower portion of the fixing core. The at least two elastic pieces of the fixing core extend out of the at least two windows of the base, respectively.

Preferably, the boss on the outer side wall of each of the elastic pieces has upper and lower inclined surfaces.

Preferably, the fast installation mechanism further comprises a set screw, an engaging post, and a spring. A top of the locking inner core has upper and lower ratchet wheels. The upper and lower ratchet wheels are secured to the faucet body through the set screw, the engaging post and the spring.

Preferably, the upper and lower ratchet wheels on the top of the locking inner core are arranged in a double-layered manner. The upper and lower ratchet wheels have upper and lower teeth in opposite directions. An upper recess is defined between every two of the upper teeth. A lower recess is defined between every two of the lower teeth. The upper teeth each overlay part of the lower recess of the lower teeth to form an engaging groove for engaging the engaging post. The set screw is inserted through a fixing hole on the faucet body and pressed against the spring and the engaging post in sequence, so that the engaging post is locked in the engaging groove of the locking inner core for fixing the locking inner core to the faucet body.

After adopting the above solutions, since the installation mechanism of the invention is disposed on the upper portion of the countertop, there is no need for the operator to be in a small space. The sight and light are good, the operation space is large, the visibility is high, and the installation is quick and simple. Because the installation is performed on the countertop, the installation of the faucet is more stable and reliable without being affected by the narrow space. The operator has comfortable operation posture, the operation is convenient and fast, and the installation efficiency is high. The invention has a simple structure and could be put into mass production.

Embodiments of the present invention will now be described, by way of example only, with reference to the accompanying drawings.

DETAILED DESCRIPTION OF THE PREFERRED EMBODIMENTS

Figure 1:
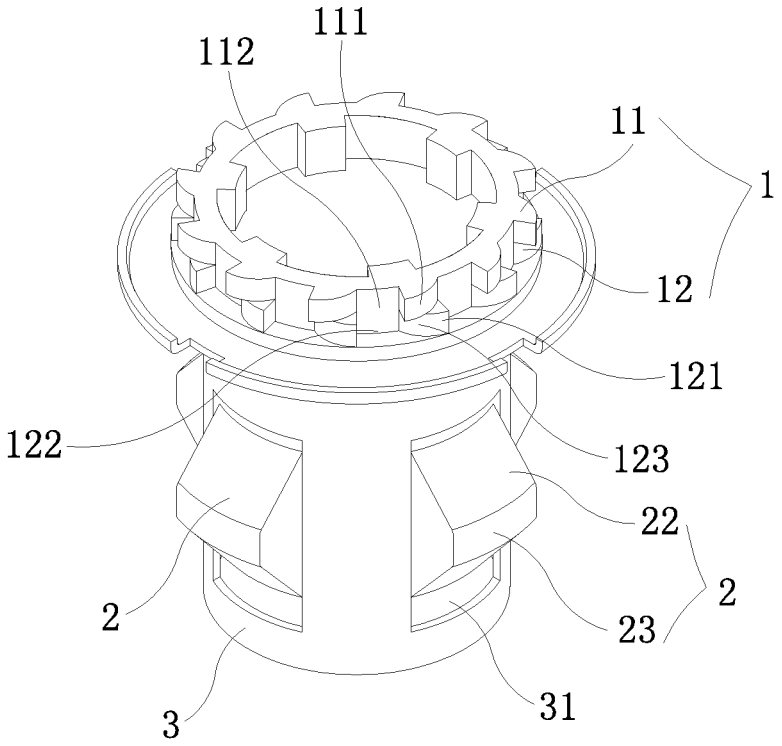
FIG. 1 is a perspective view of the present invention.
Figure 2:
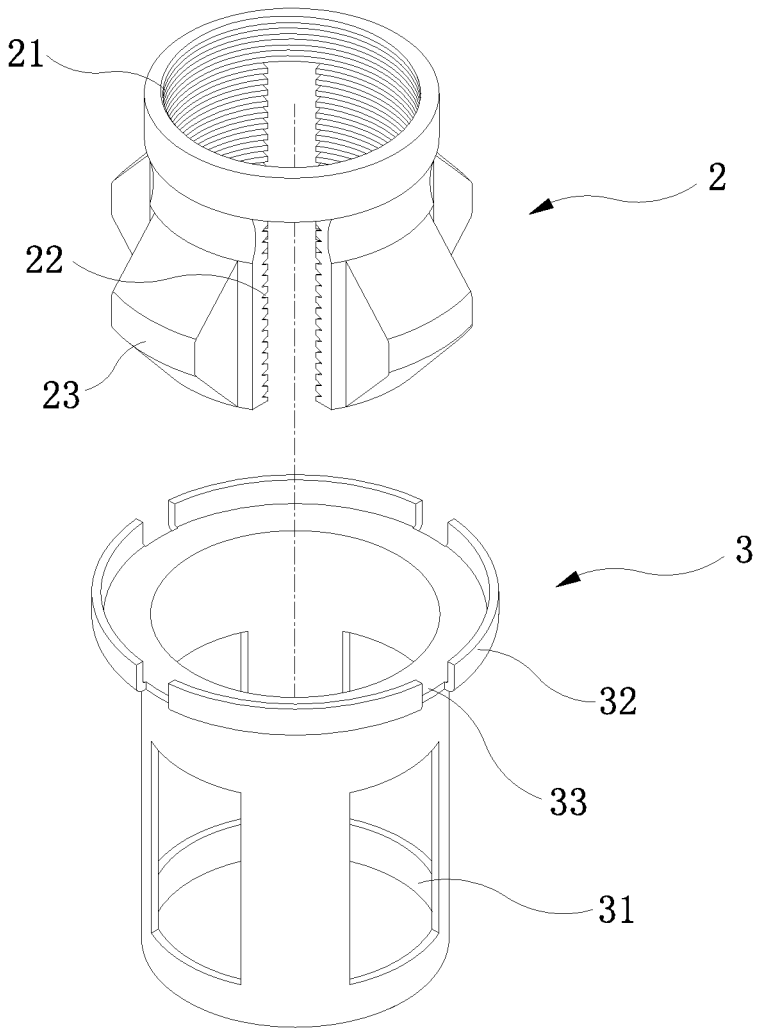
FIG. 2 is an exploded view showing the fixing core and the base of the present invention.
Figure 3:
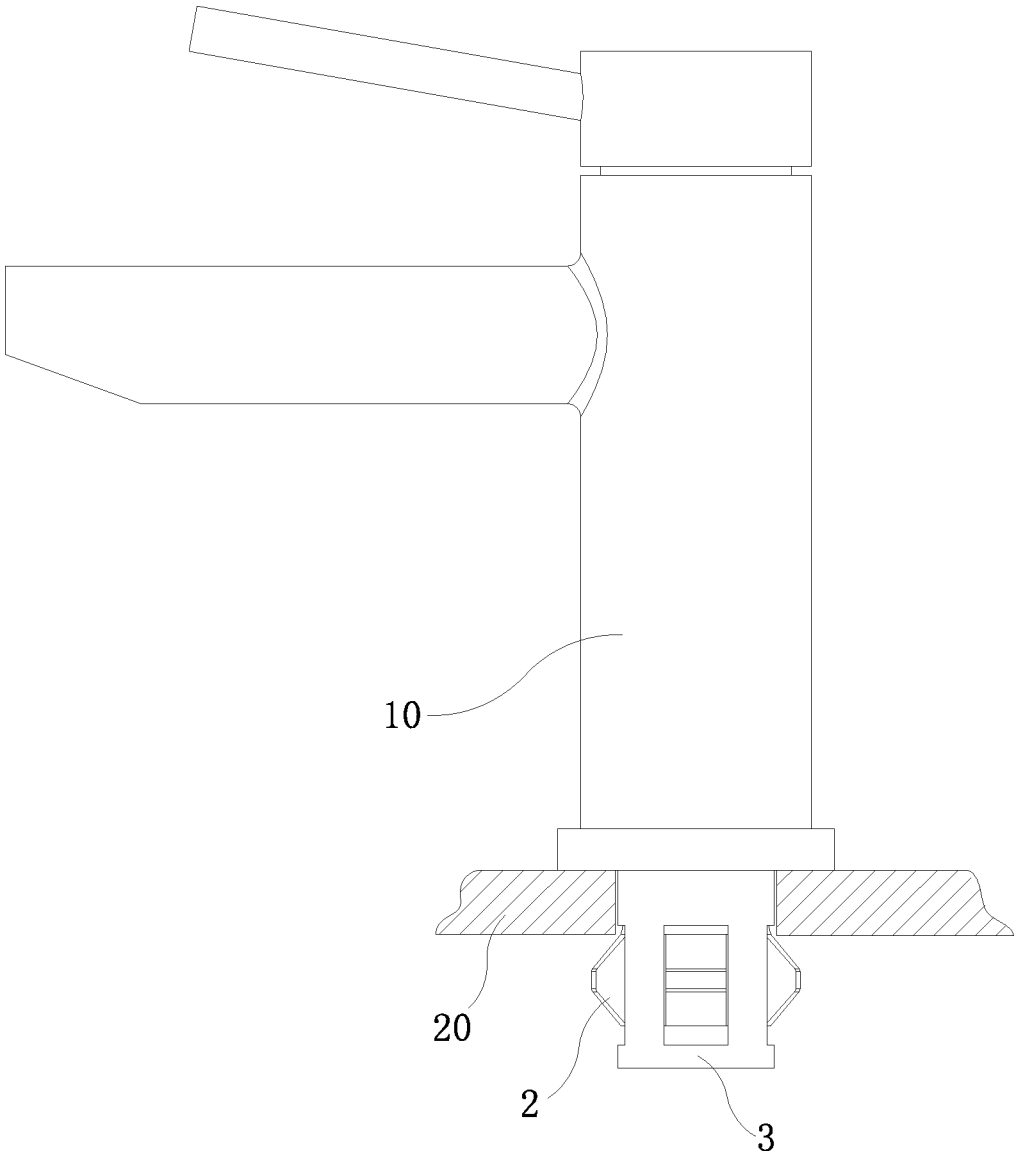
FIG. 3 is a schematic view of the present invention mounted to the countertop.
Figure 4:
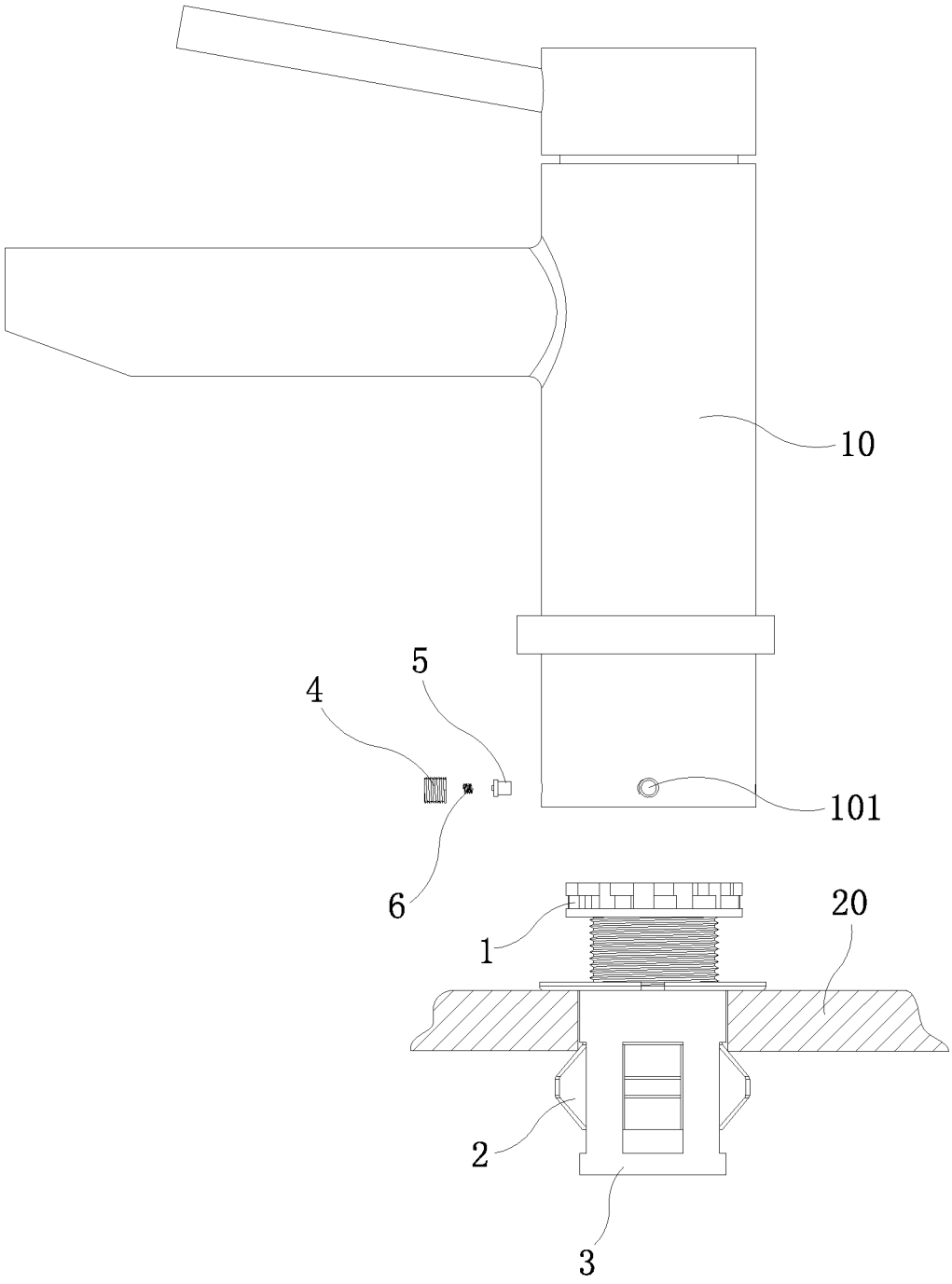
FIG. 4 is an exploded view of the present invention mounted to the countertop.
Figure 5:
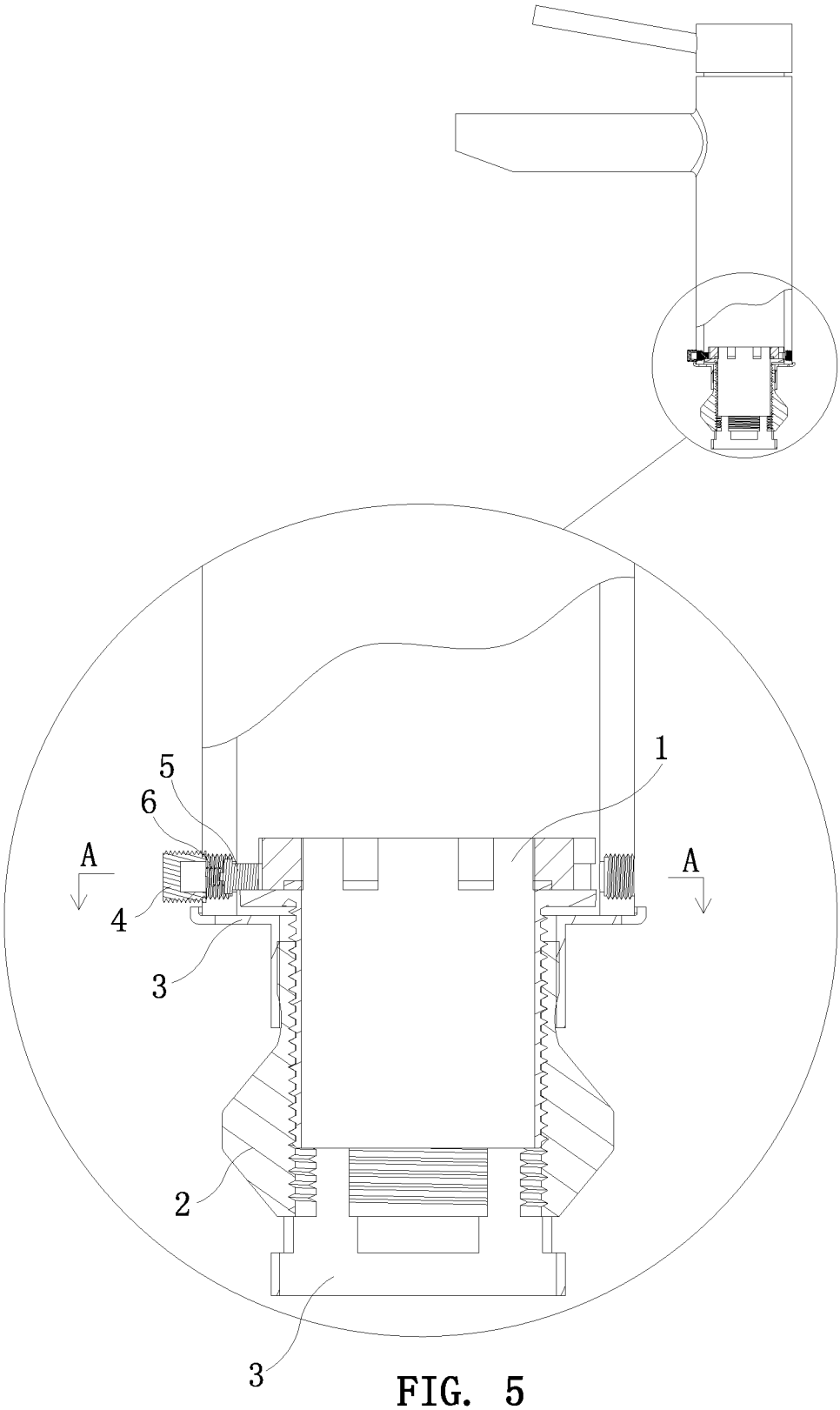
FIG. 5 is a cross-sectional view of the present invention mounted to the countertop in a tight state.

As shown in FIG. 1 through FIG. 8, the present invention discloses a fast installation mechanism for a faucet. The fast installation mechanism comprises a locking inner core 1, a fixing core 2, a base 3, a set screw 4, an engaging post 5, and a spring 6.

The upper portion of the fixing core 2 is a circular sleeve 21, and the lower portion of the fixing core 2 is composed of four elastic pieces 22. The elastic pieces 22 extend downward from the underside of the circular sleeve 21. The outer side wall of each elastic piece 22 is a boss 23 having upper and lower inclined surfaces, which is a wedge-shaped configuration. Internal threads are formed on the inner walls of the circular sleeve 21 and the elastic pieces 22.

The base 3 is a tubular member. The lower side wall of the base 3 is formed with four windows 31. The number of the windows 31 is the same as the number of the elastic pieces 22 of the fixing core 2. The top of the base 3 has an annular collar 32.

The top of the locking inner core 1 has upper and lower ratchet wheels 11, 12 arranged in a double-layered manner. The upper and lower ratchet wheels 11, 12 have upper and lower teeth 111, 121 in opposite directions. An upper recess 112 is defined between every two of the upper teeth 111, and a lower recess 122 is defined between every two of the lower teeth 121. The upper teeth 111 each overlay part of the lower recess 122 of the lower teeth 121 to form an engaging groove 123 for engaging the engaging post 5, so that the set screw 4 fixes the locking inner core 1 and a faucet body 10 together. The upper end of the locking inner core 1 is fixedly connected to the faucet body 10, and the lower portion of the locking inner core 1 is screwed into the fixing core 2. The base 3 is sleeved on the lower portion of the fixing core 2. The four elastic pieces 22 of the fixing core 2 extend out of the four windows 31 of the base 3, respectively.

The set screw 4 is inserted through a fixing hole 101 on the faucet body 10 and pressed against the spring 6 and the engaging post 5 in sequence, so that the engaging post 5 is locked in the engaging groove 123 of the locking inner core 1 for fixing the locking inner core 1 to the faucet body 10.

Figure 6:
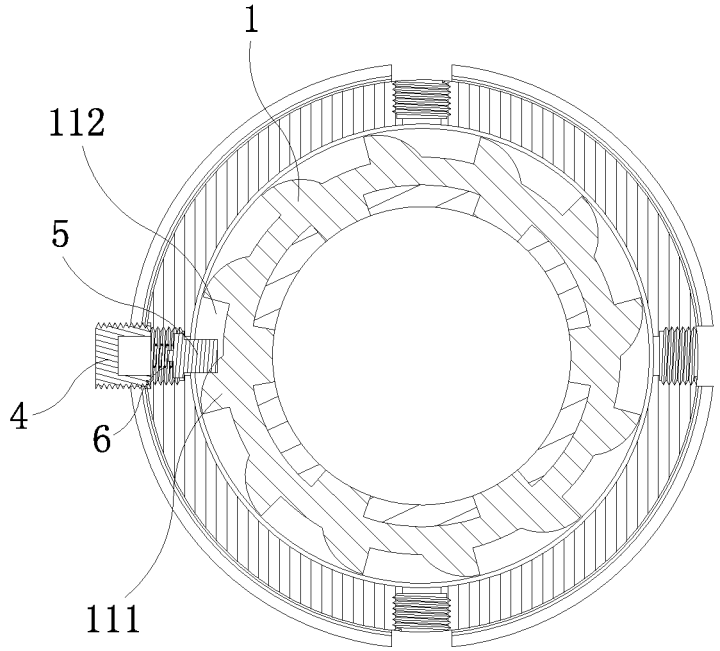
FIG. 6 is a cross-sectional view taken along line A-A of FIG. 5.
Figure 7:
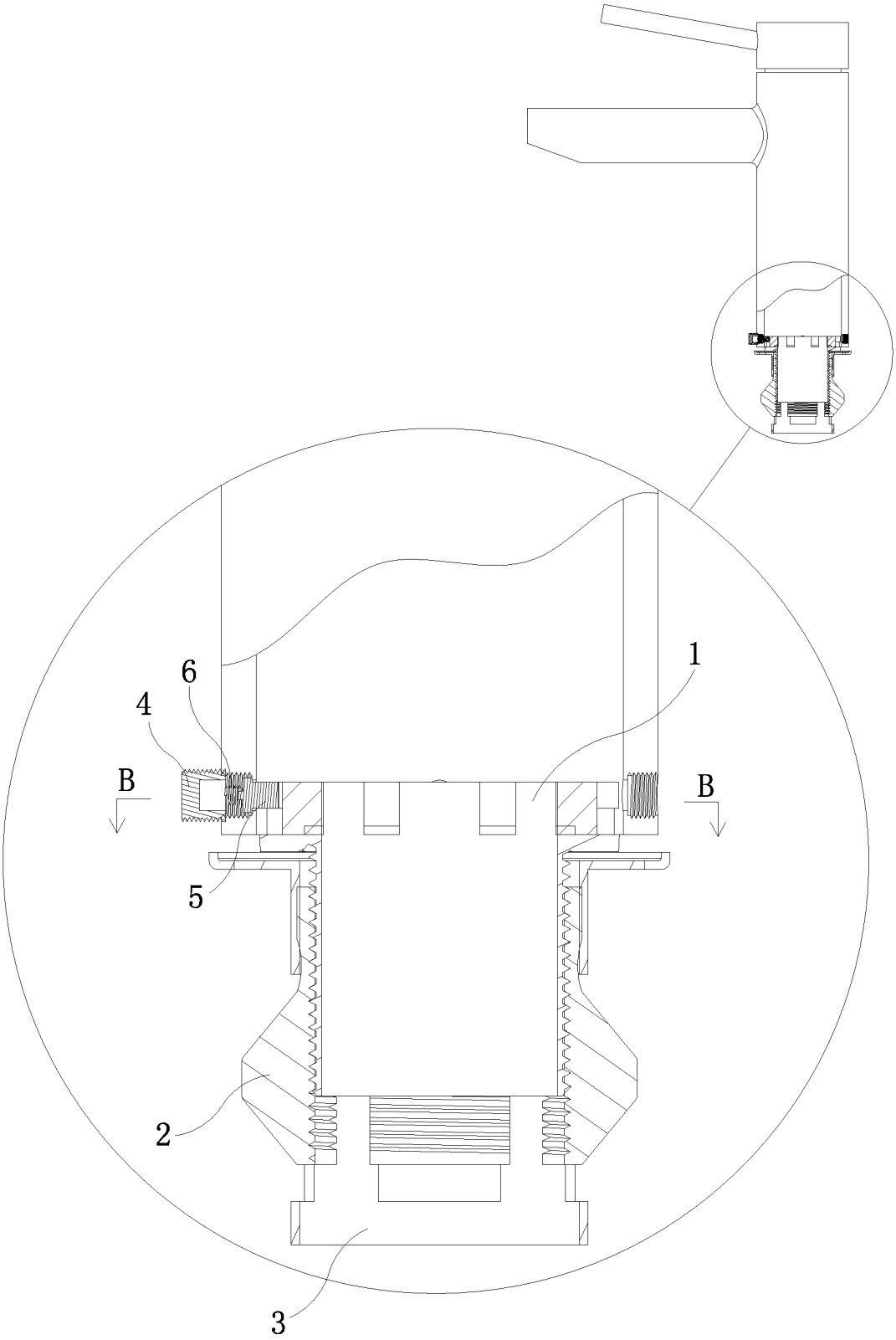
FIG. 7 is a cross-sectional view of the present invention mounted to the countertop in a loose state.
Figure 8:
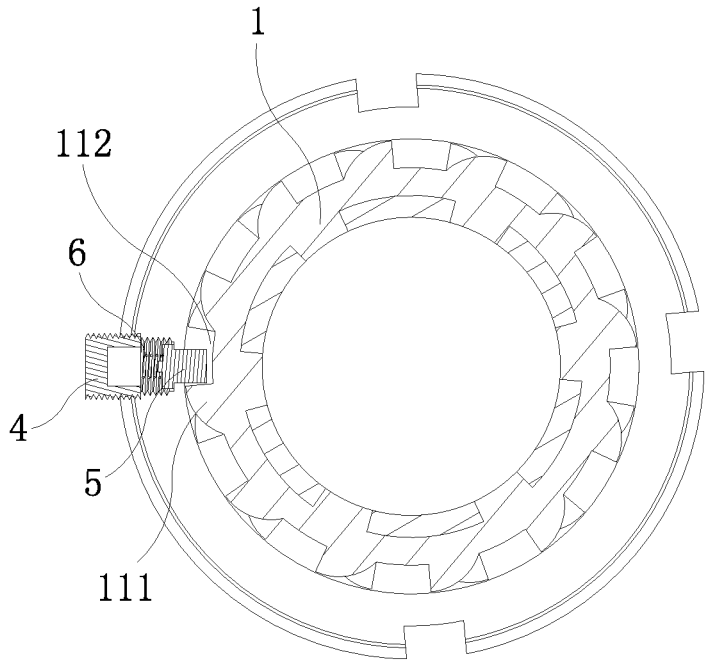
FIG. 8 is a cross-sectional view taken along line B-B of FIG. 7.

The installation method of this embodiment:

The locking inner core 1 is screwed into the fixing core 2 until the opening of the fixing core 2. The four elastic pieces 22 of the fixing core 2 have the characteristics of compression and elastic rebound. The installation mechanism of the present invention is inserted from the upper portion of the countertop 20 into the mounting hole of the faucet or the sink. The locking inner core 1 is tightened clockwise. When the locking inner core 1 is tightened, the fixing core 2 is driven to move upwardly. Since the outer wall of the fixing core 2 is a wedge-shaped configuration, the tighter the locking inner core 1 is screwed, the greater the clamping force of the wedge-shaped configuration of the fixing core 2 on the countertop 20. Furthermore, since the locking inner core 1 is screwed to the lower portions of the four elastic pieces 22 of the fixing core 2, there is no space for deformation inside the four elastic pieces 22, so that the base 3 is stably mounted to the countertop 20. The joint portion of the locking inner core 1 and the faucet body 10 is formed into the double-layered bidirectional upper and lower ratchet wheels 11, 12 (as shown in FIG. 6). Four engaging posts 5 are evenly distributed on the faucet body 10. When the faucet body 10 is to be mounted, the bottom of the faucet body 10 and the upper surface of the base 3 are pressed, the base 3 is fixed with a plier, and the faucet body 10 is rotated clockwise until it cannot be further rotated. Then, the faucet body 10 is rotated counterclockwise to the initial position and then rotated clockwise. This way can be repeated several times so as to lock the faucet body 10. After adjusting the position of the nozzle of the faucet, the four set screws 4 corresponding in position to the engaging posts 5 are locked. The set screws 4 press the engaging posts 5 into the engaging grooves 123 of the upper and lower ratchet wheels 11, 12 to secure the faucet body 10. The decorative cover is slid to the bottom of the faucet to cover the installation accessories, such that the installation is completed. When the faucet is to be dismounted, the set screws 4 are loosened, the faucet body 10 is rotated counterclockwise, and the engaging posts 5 are disengaged from the engaging grooves 123, so that the locking inner core 1 can be loosened. This way can be repeated several times until the locking inner core 1 is completely loosened, so that the faucet body 10 can be separated from the base 3, and the installation mechanism of the present invention is taken out from the countertop 20 to complete the disassembly.

Although particular embodiments of the present invention have been described in detail for purposes of illustration, various modifications and enhancements may be made without departing from the spirit and scope of the present invention. Accordingly, the present invention is not to be limited except as by the appended claims

What is claimed is:

1. A fast installation mechanism for a faucet, comprising a locking inner core, a fixing core, and a base; an upper portion of the fixing core being a circular sleeve, a lower portion of the fixing core being composed of at least two elastic pieces, the elastic pieces extending downward from an underside of the circular sleeve, an outer side wall of each of the elastic pieces having a boss, internal threads being formed on inner walls of the circular sleeve and the elastic pieces; the base being a tubular member, a lower side wall of the base being formed with at least two windows, the windows corresponding in number to the elastic pieces of the fixing core; the locking inner core being a tubular member, an external thread being formed on an outer wall of the locking inner core, an upper end of the locking inner core being fixedly connected to a faucet body, a lower portion of the locking inner core being screwed into the fixing core, the base being sleeved on the lower portion of the fixing core, the at least two elastic pieces of the fixing core extending out of the at least two windows of the base, respectively.

2. The fast installation mechanism as claimed in claim 1, wherein the boss on the outer side wall of each of the elastic pieces has upper and lower inclined surfaces.

3. The fast installation mechanism as claimed in claim 1, further comprising a set screw, an engaging post and a spring; a top of the locking inner core having upper and lower ratchet wheels, the upper and lower ratchet wheels being secured to the faucet body through the set screw, the engaging post and the spring.

4. The fast installation mechanism as claimed in claim 3, wherein the upper and lower ratchet wheels on the top of the locking inner core are arranged in a double-layered manner, the upper and lower ratchet wheels have upper and lower teeth in opposite directions, an upper recess is defined between every two of the upper teeth, a lower recess is defined between every two of the lower teeth, the upper teeth each overlay part of the lower recess of the lower teeth to form an engaging groove for engaging the engaging post; the set screw is inserted through a fixing hole on the faucet body and pressed against the spring and the engaging post in sequence, so that the engaging post is locked in the engaging groove of the locking inner core for fixing the locking inner core to the faucet body.

* * * * *